United States Patent [19]

Schneider et al.

[11] 4,134,180

[45] Jan. 16, 1979

[54] HINGE FOR DOOR LEAVES WHICH LIE FLUSH, PARTICULARLY A FURNITURE HINGE

[75] Inventors: Eberhard Schneider, Cologne; Theodor Vitt, Porz-Eil, both of Fed. Rep. of Germany

[73] Assignee: Prämeta Präzisionsmetaal -und Kunststofferzeugniss G. Baumann & Co., Cologne, Fed. Rep. of Germany

[21] Appl. No.: 853,430

[22] Filed: Nov. 21, 1977

[30] Foreign Application Priority Data

Dec. 3, 1976 [DE] Fed. Rep. of Germany ..... 2654792

[51] Int. Cl.[2] ..... E05D 7/04

[52] U.S. Cl. ..... 16/129

[58] Field of Search ..... 16/129–134

[56] References Cited

U.S. PATENT DOCUMENTS 3,748,689 7/1973 Grunert ..... 16/129

3,909,879 10/1975 Grunert et al. ..... 16/129

FOREIGN PATENT DOCUMENTS 1233302 1/1967 Fed. Rep. of Germany ..... 16/131

*Primary Examiner*—James Kee Chi

*Attorney, Agent, or Firm*—Diller, Ramik & Wight

[57] ABSTRACT

This disclosure is directed to a furniture hinge which includes first, second, and intermediate hinge elements with the first intermediate hinge elements being pivotably connected to each other and means mounting the second and intermediate hinge elements for relative linear movement therebetween, the intermediate hinge element including a generally T-shaped projection, and a screw threadably received in a threaded bore of the intermediate hinge element and being generally irremovably secured to the second hinge element whereby upon rotation of the screw relative motion is provided between the intermediate and second hinge elements and upon the disassembly of the intermediate hinge element from the second hinge element, the latter retains the screw therewith whereby the screw can not be inadvertently, accidentally or otherwise lost.

7 Claims, 3 Drawing Figures

HINGE FOR DOOR LEAVES WHICH LIE FLUSH, PARTICULARLY A FURNITURE HINGE

The present invention is directed to a novel furniture hinge for opening a door or leaf relative to a furniture frame of the type in which an intermediate hinge element has a generally T-shaped projection carrying an adjustment screw for adjusting the relative position between first and second hinge elements to thereby adjust the position of a furniture door or leaf relative to a furniture frame. Hinges of this type generally include a locking screw for locking the frame hinge element to the intermediate hinge element and another adjusting screw is provided for side adjustment of the leaf or door relative to the frame.

Hinges are also known which are used for furniture leaves or doors which lie flush with the furniture frame in which a hinge element which is attached to the frame is divided into a pair of sections. One of the sections is connected flexibly to a hinge element which is connected to the leaf or door and the two sections are guided for movement relative to each other. Generally there is an adjustment screw located between the two sections, as viewed in the direction of the screw axis, with one portion of the screw cooperating with one section and an opposite portion of the screw cooperating with the other section to permit relative motion between the sections upon rotation of the screw. If the door leaf is to be removed from the frame, the latter hinge design is such that the screw associated with the two sections is independent of each and may be lost, mislayed, or otherwise inadvertently or accidentally misplaced. Moreover, considerable difficulties arise is reconnecting the two sections by means of the adjustment screw, particularly if the remaining elements of the hinge, namely, the section of the hinge element attached to the frame and the leaf element attached to the leaf remain respectively attached to their frame and leaf.

In keeping with the foregoing it is a primary object of the present invention to provide a novel hinge for furniture leaves or doors which lie flush relative to a frame in which a screw is generally irremovably carried by a hinge element which is secured to the frame such that upon removal of the leaf or door and the hinge element associated therewith, the screw remains undetached and can not be misplaced or lost. In addition, the screw not only functions for adjusting purposes between the frame and door or leaf but also serves to lock the frame and door hinge elements relative to each other at any one of ennumerable number of preselected positions.

In further accordance with this invention the screw which is generally carried by the frame hinge element is rotatably carried by the latter but axial motion between the screw and frame hinge element is precluded whereby adjustment or rotation of the screw permits relative movement of the leaf or door hinge element relative to the frame hinge element.

In further accordance with this invention a novel hinge is provided of the type aforesaid wherein the leaf or door hinge element pivotably carries an intermediate hinge element having a generally T-shaped projection carrying the adjusting screw in a threaded bore thereof, the T-shaped projection having a neck portion guidably received in a slot of the frame hinge element, and the screw having a terminal portion rotatably received in a bore of the frame hinge element but being generally irremovably secured thereto through the use of an enlarged terminal head of a size precluding the withdrawal of the latter through the bore of the frame hinge element.

In further accordance with this invention the screw which is generally irremovably carried by the frame hinge element not only can not become lost but conventional additional locking screws heretofore employed become dispensable although obviously a locking screw may be further utilized in keeping with the present invention to additionally lock the intermediate hinge element to the frame hinge element separate in part from the locking achieved through the adjusting screw and the T-shaped projection of the intermediate hinge element.

In further accordance with this invention the novel furniture hinge preferably is disposed either centrally of or in the arm of a cross bar of the T-shaped portion or projection of the intermediate hinge element and may include a transverse slot for the reception of a screw driver blade or head or may be of a raised polygonal configuration or as a recessed polygonal shape to receive a like-shaped socket head or Allen wrench.

With the above and other objects in view that will hereinafter appear, the nature of the invention will be more clearly understood by reference to the following detailed description, the appended claims and the several views illustrated in the accompanying drawings.

Figure 1:
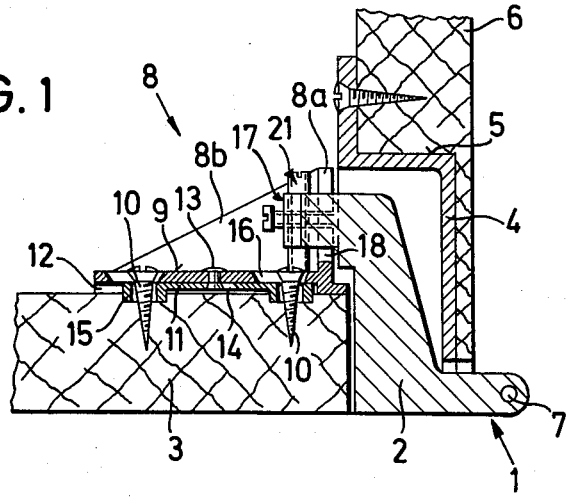
FIG. 1 is a fragmentary cross-sectional view taken through a novel furniture hinge constructed in accordance with this invention, and illustrates the closed position of a frame and door through the use of first, second, and intermediate hinge elements, the latter two of which are relatively adjustable by an adjusting screw generally and removably carried by the frame hinge or second element.

A novel hinge constructed in accordance with this invention is generally designated by the reference numeral 1 and includes an intermediate hinge element 2 between a first, leaf or door hinge element 4 and a frame hinge element 8. The hinge element 4 is partially received in a recess 5 of a leaf or door 6 which in turn forms a portion of a suitable piece of furniture as does a frame 3. A pivot pin 7 secures the intermediate hinge element 2 to the leaf hinge element 4.

The frame hinge element 8 includes a base 9 having a pair of upstanding walls **8*b*, 8*b*', and upstanding end walls 8*a*, 8*a*' between which is an elongated upwardly opening slot 18. As is also best illustrated in FIG. 2, the walls 8*b*, 8*b*' have vertical grooves or recesses 8*c*, 8*c*' for receiving end portions 17*b*, 17*c* of a cross bar or T-shaped projection 17 having a neck 17*a* received in and guided by the slot 18. The T-shaped projection or portion 17 is shown as a separate element secured by a screw 19 to the hinge element 2 but the elements 2, 17** may be of an integral one-piece construction.

A pair of screws 19 pass through elongated opening 16 in the base or base plate 9 of the hinge element 8 and also pass through bores 15 in an underline guide plate 11 which is received in a groove 12 formed in the underside of the plate 19. Prior to tightening the screws 10 into the frame 3, the groove 12 allows the hinge element 8 to be slid to the left or the right as viewed in FIG. 1 relative to the guide plate 11. The latter-noted sliding movement is limited by a rivet 13 secured to the plate 19 and having a head (unnumbered) received in an elongated slot 14 of the plate 11.

Figure 2:
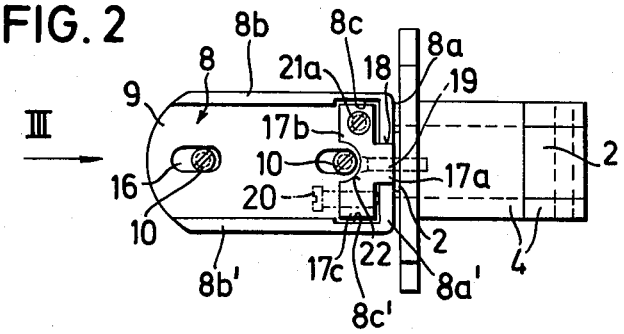
FIG. 2 is a generally top plan view of the hinge of FIG. 1 with the frame and leaf removed for clarity and illustrates the adjusting screw carried by an end portion of a cross bar of a generally T-shaped portion of the intermediate hinge element.

Reference is now made specifically to FIG. 2 in which the arm **17*b*, 17*c* are received in the respective slots or recesses 8*c*, 8*c*' to guide vertical upward and downward motion of the T-shaped projection 17 relative to the vertical walls 8*b*, 8*b*' and, therefore, relative to the frame hinge element 8. The vertical motion of the T-shaped projection 17 is transfered to the pivot or pivot pin 7 to the leaf hinge element 4 and thus to the leaf or door 6 so that the latter may be adjusted relative to the frame 3 through the use of an adjusting screw 21 having a head 21*d* slotted to receive the blade of a screw driver or the like. Virtually the entire shank of the screw 21 is threaded, as indicated at 21*a*, and a reduced terminal end portion or neck 21*c* is received in a circular bore or opening (unnumbered) of the base plate 9 and is restrained against axial motion by an enlarged head 21*b* which is of a size preventing the withdrawal of the screw in an upward direction. Withdrawal of the screw in a downward direction is prevented by the threaded portion 21*a* of the screw 21 which is of a diameter larger than the bore (again unnumbered) in the base plate 9 of the frame hinge element 8. Due to the latter-described connection, the screw 21 is prevented from moving axially but is free to rotate in either a clockwise or a counter-clockwise direction. The screw 21 is, of course, received in a threaded bore (unnumbered) in the arm 17*b* of the T-shaped projection 17. Thus, as the screw 21 is rotated, the same is free to rotate relative to the frame hinge element 8 due to the unthreaded nature of the neck 21*c* and its freedom of rotation in the bore (unnumbered) of the base plate 9, although the same rotation imparted to the screw 21 permits the T-shaped projection to move either upwardly or downwardly relative to the axis of the screw 21, depending upon the direction of rotation of the latter, to shift the leaf hinge element 4 relative to the frame hinge element 8 and thus achieve adjustment between the frame 3 and the leaf or door 6. It is to be particularly noted that due to the threaded relationship between the screw 21 and the T-shaped projection 17 any position of relative adjustment between the T-shaped projection 17 and the frame hinge element 8 is retained simply because of the threaded engagement between the threaded portion 21*a* of the screw 21 and the threaded bore (unnumbered) of the T-shaped projection 17. Thus, additional or auxiliary locking means of any type are not necessary although if the locking achieved by the adjusting and locking screw 21 is to be augmented, a locking screw such as the screw 20, may be threaded into the arm 17*c* to bear against the wall 8*a*' (FIG. 2**) for additional locking purposes.

The arms of the cross bar **17*b*, 17*c* are interrupted centerally by an indentation or recess 22 to permit access to one of the underlying screw heads 10 in the manner best shown in FIG. 2 in order that the leaf 6 need not be removed for displacement or adjusting purposes. Moreover, though the screw 21 is located eccentrically relative to the T-shaped projection 17, namely, in the arm or end 17*b* the same may be located centerally of both arms 17*b*, 17*c* and in such case the indentation 22 would be eliminated and the underlying screw 10 (FIG. 2) merely shifted to the left along with its associated slots 16 and 15**.

Figure 3:
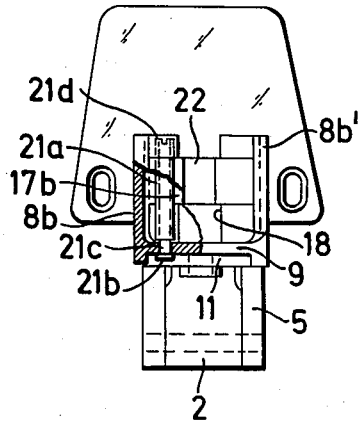
FIG. 3 is an end elevational view with a portion thereof broken away for clarity taken generally along the line III of FIG. 2, and illustrates a portion of the screw received in a bore of the frame hinge element and a terminal enlarged head of the screw preventing withdrawal or axial motion of the screw relative to the frame hinge element.

In lieu of the slot in the head **21*d* of the screw 21 the head 21*d* may have an exterior polygonal configuration for the receipt of a drive socket or may have a polygonal recess for an Allen wrench. Irrespective of variation in the structure thus far specifically described it is to be understood that the importance of this invention is the fact that the screw 21 can not be displaced vertically as viewed in FIG. 3, either upwardly or downwardly, though it can be rotated to not only adjust the intermediate hinge element 2 and thus the leaf hinge element 4 relative to the frame hinge element 8 but also to lock the intermediate hinge element 2 relative to the hinge element 8 separate and apart from auxiliary or additive locking means, such as the locking screw 20**.

Although only a preferred embodiment of the invention has been specifically illustrated and described herein, it is to be understood that minor variations may be made [in the apparatus or in the method of] without departing from the spirit and scope of the invention, as defined in the appended claims.

We claim:

1. A hinge comprising first and second hinge elements, an intermediate hinge element, means movably connecting said first and intermediate hinge elements for relative movement therebetween, means mounting said second and intermediate hinge elements for relative linear movement therebetween, means for imparting relative linear movement between said second and intermediate hinge elements, said movement imparting means being a screw, said screw being free to rotate relative to both said second and intermediate hinge elements, said intermediate hinge element including a generally T-shaped projection, said T-shaped projection including a threaded bore threadably receiving said screw, and means for restraining said screw against linear movement relative to both said second and intermediate hinge elements and for irremovably screwing said screw to said second hinge element whereby rotation of said screw imparts relative motion between said second and intermediate hinge elements and retains any relative position therebetween.

2. The hinge as defined in claim 1 wherein said mounting means includes an elongated slot guidingly receiving a portion of said intermediate hinge element, and said slot and screw have generally parallel axis.

3. The hinge as defined in claim 1 wherein said intermediate hinge element moves generally linearly relative to said second hinge element upon rotation of said screw.

4. The hinge as defined in claim 1 wherein said intermediate hinge element is removable from said screw, said screw is irremovably carried by said second hinge element, said screw having first and second terminal end portions at opposite sides of said T-shaped projection, said restraining and securing means being carried by said first terminal end portion, and said second terminal end portion being of a diameter to completely threadably pass through said threaded bore whereby said intermediate hinge element can be removed from said screw without affecting the irremovable securement of said screw to said second hinge element.

5. The hinge as defined in claim 1 wherein said screw includes a terminal end portion freely received in a bore of said second hinge element, and said restraining and securing means includes an enlarged integral terminal head carried by said terminal end porton of a size precluding the passage of said head through said second hinge element bore.

6. The hinge as defined in claim 5 wherein said T-shaped projection includes a cross bar having opposite arms, and said threaded bore is disposed in one of said arms.

7. The hinge as defined in claim 5 wherein said screw includes another terminal end portion, and said another terminal end portion being of a diameter to completely threadably pass through said threaded bore whereby said intermediate hinge element can be removed from said screw without affecting the irremovable securement of said screw to said second hinge element.

* * * * *

UNITED STATES PATENT AND TRADEMARK OFFICE

CERTIFICATE OF CORRECTION

PATENT NO. : 4,134,180

DATED Jan. 16, 1979

INVENTOR(S) : Eberhard Schneider et al

It is certified that error appears in the above-identified patent and that said Letters Patent are hereby corrected as shown below:

---[73] Assignee: Prämeta Präzisionsmetall -und Kunststofferzeugniss G. Baumann & Co. Cologne, Fed. Rep. of Germany--

Signed and Sealed this

*Eighteenth* Day of *September 1979*

[SEAL]

*Attest:*

*Attesting Officer*

LUTRELLE F. PARKER

*Acting Commissioner of Patents and Trademarks*